US005197688A

United States Patent [19]

Giorgio et al.

[11] Patent Number: 5,197,688

[45] Date of Patent: Mar. 30, 1993

[54] METHOD AND DEVICE FOR CUTTING AN ADHESIVE BAND SEALING A REEL OF WEB MATERIAL

[75] Inventors: Vaccari Giorgio; Alessandro Minarelli, both of Bologna, Italy

[73] Assignee: G.D. Societa per Azioni, Bologna, Italy

[21] Appl. No.: 833,989

[22] Filed: Feb. 11, 1992

[30] Foreign Application Priority Data

Feb. 26, 1991 [IT] Italy ..... BO91 A 000051

[51] Int. Cl.[5] ..... B65H 19/18

[52] U.S. Cl. ..... 242/78.8; 242/55

[58] Field of Search ..... 242/78.8, 55, 56 R, 242/58.5; 83/649

[56] References Cited

U.S. PATENT DOCUMENTS 4,688,736 8/1987 Brinker ..... 242/78.8 X 4,821,971 4/1989 Watanabe ..... 242/78.8 X

*Primary Examiner*—Harry N. Haroian

*Attorney, Agent, or Firm*—Ladas & Parry

[57] ABSTRACT

A method and device (1) for cutting a sealing band (4) on a reel (2) of web material, in which the reel (2), arranged on a support (8) and coupled to a motorized unwinding device (7), is rotated about its axis (10) until the end edge (6) of the initial turn (5) of the reel (2) passes in front of a sensor (17), which causes the motorized unwinding device (7) to move the edge (6) of the initial turn (5) of the reel (2) towards a cutting member (21) carried by the support (8) and comprising two appendices (22) which are perpendicular to the axis (10) of rotation of the reel (2) and are joined together by a V-shaped concave cutting edge (23); the appendices (22) of the cutting member (21) are elastically urged into contact with the outer periphery (11) of the reel (2), to engage below the free edge (6) of the initial turn (5) from opposite sides of the band (4), and transversely cut the band (4).

10 Claims, 1 Drawing Sheet

METHOD AND DEVICE FOR CUTTING AN ADHESIVE BAND SEALING A REEL OF WEB MATERIAL

Figure 1:
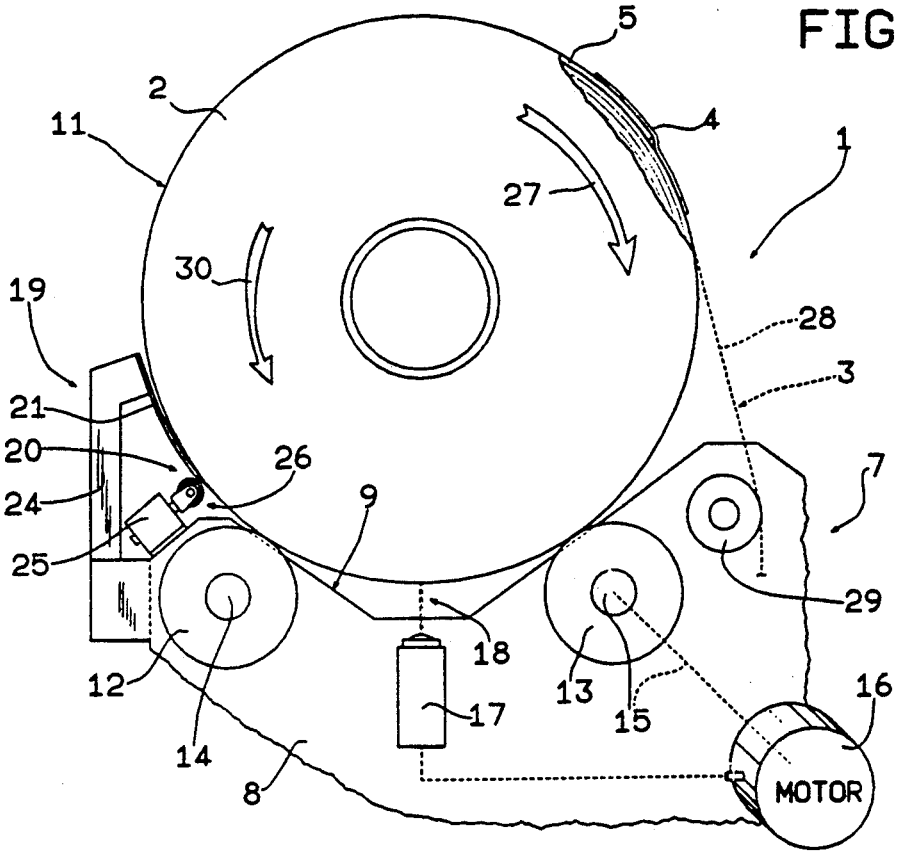

This invention relates to a method for cutting an adhesive band sealing a reel of web material.

The invention is advantageously used in the packaging sector, to which specific reference will be made hereinafter but without detracting from its generality, and in which the reels of web material used are normally provided with an external adhesive band by the manufacturer. The purpose of this band is to secure the free end edge of the first turn of the relative reel to prevent the turns unwinding during transport and handling prior to the use of the reel.

At the present time, in non-automated plants using such reels, the band is removed manually by an operator immediately prior to their use.

In automated plants the reels are fed to their zone of use without human intervention, in which zone the free end edge of the first turn of each reel has to be automatically spliced to or made to follow the trailing end of a respective expiring reel. In order for this operation to be effected, automatic devices are required to release the initial turn of each reel from the respective securing band.

To this end it is known, for example from GB patent 2,035,966, to neutralize the action of the sealing band by cutting and removing the initial turn of each reel using suitable cutting and withdrawal devices.

This type of known procedure is very complicated and cannot guarantee that said cutting means do not also damage the turns below the first.

The object of the present invention is to provide a method by which an adhesive band sealing a reel of web material can be cut in a simple and absolutely reliable manner without damaging the reel turns in any way.

The present invention provides a method for cutting an adhesive band sealing a reel of web material, said band securing the free end edge of the initial reel turn in position, characterised by comprising the following stages: coupling the reel to a motorized unwinding device to cause the reel to undergo a first rotation about its axis until said free edge lies in front of a sensor positioned at a sensing station; by means of said sensor, causing the motorized unwinding device to impose on the reel a second rotation through a determined angle from the sensing station in the normal unwinding direction, in order to move said initial turn, with said free edge leading, towards a fixed cutting member positioned at a cutting station and comprising two appendices joined together by a concave cutting edge facing said sensing station; said appendices being substantially tangential to the path followed by said free edge during said second rotation, and being urged into contact with the outer peripheral surface of the reel; and cutting the band transversely by the progressive engagement of said appendices below said free edge from opposite sides of the band; said angle terminating at said cutting station immediately downstream of said cutting edge in the normal unwinding direction.

The present invention also relates to a device for implementing the aforesaid method.

Hence, the invention provides a device for cutting an adhesive band sealing a reel of web material, said band securing the free end edge of the initial turn of the reel in position, characterised by comprising a support for said reel; a motorized unwinding device for rotating the reel about its axis; a sensor which when in use faces the outer peripheral surface of the reel at a sensing station to sense the passage of said free edge in front of the sensor and cause the motorized unwinding device to rotate the reel in the normal unwinding direction in order to move said initial turn, with said free edge leading, towards a fixed cutting member for said band; a cutting member positioned at said cutting station and comprising two appendices facing the sensing station and joined together by a concave cutting edge preferably of V shape; and pusher means cooperating with said appendices to urge the appendices into contact with the outer peripheral surface of the reel.

Figure 2:
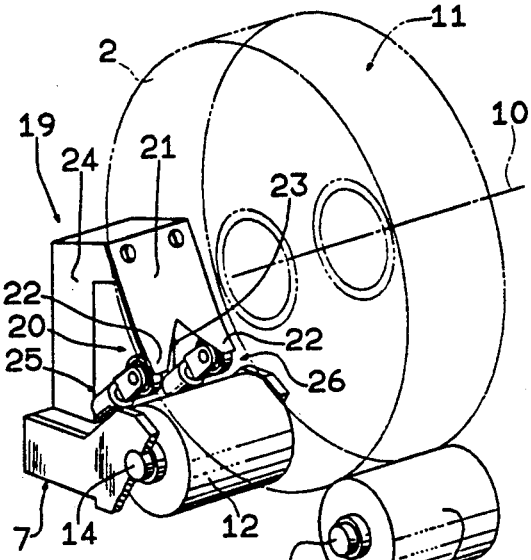
Figure 3:
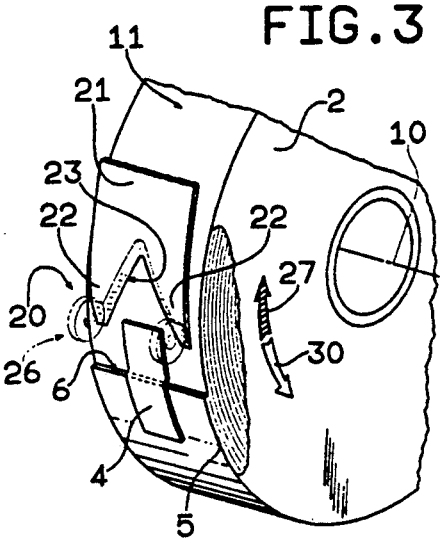

The present invention is described hereinafter with reference to the accompanying drawings, which show a non-limiting embodiment thereof, and in which:

FIG. 1 is a schematic elevational view of a preferred embodiment of the device according to the present invention; and FIGS. 2 and 3 are perspective views, with parts removed for clarity, of the respective details of FIG. 1.

In FIG. 1, the reference numeral 1 indicates overall a device which cooperates with a reel 2 containing a web 3 of packaging material, in order to cut an adhesive band 4 which maintains the most outer turn 5 of the reel 2 adhering to the reel assembly by securing thereto the free end 6 (FIG. 3) of the turn 5. The device 1 comprises a motorized unwinding device 7 for the reels 2, which comprises a support or base 8 upperly limited by a concave surface 9 and supporting the reel 2 with its axis 10 (FIG. 2) horizontal and its peripheral surface 11 substantially parallel to the surface 9 and in contact with the outer periphery of two rollers 12 and 13.

The rollers 12 and 13 are mounted on the base 8 so that their periphery projects above the surface 9, the first consisting of a roller idly mounted on a shaft 14 carried by the base 8 and parallel to the axis 10, and the second consisting of a drive roller keyed onto the output shaft 15 of a reversible motor 16. The device 1 also comprises a sensor 17 mounted on the base 8 at a sensing station 18 and arranged to control the motor 16, and a cutting unit 19 mounted at a cutting station 20 which when in use is positioned substantially along the peripheral surface 11 of the reel 2 in proximity to the roller 12 and beyond that part of the surface 9 lying between the two rollers 12 and 13.

The cutting unit 19 comprises an elastic metal blade 21 provided, at that end facing the roller 12 and the sensing station 18, with two appendices 22 extending towards the roller 12 in a direction perpendicular to the axis 10 of rotation of the reel 2, and joined together by a concave cutting edge 23 of V shape. The cutting unit 19 also comprises an upright 24 extending upwards from the base 8 and having an upper supporting end rigidly connected to that end portion of the blade 21 distant from the edge 23. The cutting unit 19 finally comprises an actuator member 25, which is carried by the base 8 in a position facing that portion of the blade 21 projecting from the upright 24 towards the roller 12 and has an output member provided with a roller-type pusher 26 arranged to cooperate with the blade 21 in proximity to the edge 23 in order to deflect it in a direction substantially radial to the reel 2 towards and from an operating position in which the appendices 22 lie tangential to the peripheral surface 11 of the reel 2.

When in use, a reel 2 to be unwound is mounted on the unwinding device 7 with its outer peripheral surface 11 in contact with the rollers 12 and 13, to be unwound in the normal unwinding direction 27, i.e. in the clockwise direction in FIG. 1. When the band 4 has been removed the reel 2 is unwound in the direction 27 by operating the motor 16 so that it rotates the roller 13 in the anti-clockwise direction in FIG. 1, and positioning the end portion 28 of the web 3 about an idle end deviation roller 29 carried by the base 8 on the opposite side of the rollers 12 and 13 to the cutting unit 19.

In order to automatically cut the band 4, the reel 2 when mounted on the unwinding device 7 is caused by the motor 16 to undergo a first rotation about its axis 10 in the direction 27 until the free edge 6 passes in front of the sensor 17. Following its sensing of the passage of the free edge 6, the sensor 17 causes the motor 16 to further rotate the reel 2 in the direction 27 through that angle required to advance the free edge 6 in the direction 27, i.e. with the free edge 6 leading, between the sensing station 18 and a position within the cutting station 20 which is just beyond the cutting edge 23.

On operating the actuator member 25 the pusher 26 elastically deflects the blade 21 outwards while maintaining the two appendices in contact with the peripheral surface 11 of the reel 2, and compensating any small diameter difference between one reel and another. Consequently, when the free edge 6 penetrates into the cutting station 20, the two appendices 22 penetrate progressively under the free edge 6 from opposite sides of the band 4, the cutting edge then progressively engaging the opposing sides of the band 4 to cut it transversely.

At this point, having completely travelled through the aforesaid determined angle, the motor 16 reverses its rotation, with consequent reversal of the rotation of the roller 13, to prevent the edge 6 jamming below the blade 21 and to rotate the reel 2 in the opposite direction 30 to the direction 27 through an angle sufficient to move the free edge 6 beyond the deviator roller 29. At this point the motor 16 is halted and is restarted in the opposite direction, in order to rotate the reel 2 in the direction 27 and enable the portion 29 to unwind about the deviator roller 29, to commence the normal unwinding of the reel 2.

We claim:

1. A method for cutting an adhesive sealing band (4) on a reel (2) of web material (3), said band (4) securing the free end edge (6) of the initial turn (5) of the reel (2) in position, characterised by comprising the following stages: coupling the reel (2) to a motorized unwinding device (7) to cause the reel (2) to undergo a first rotation about its axis (10) until said free edge (6) lies in front of a sensor (17) positioned at a sensing station (18); by means of said sensor (17), causing the motorized unwinding device (7) to impose on the reel (2) a second rotation through a determined angle from the sensing station (18) in the normal unwinding direction (27), in order to move said initial turn (5), with said free edge (6) leading, towards a fixed cutting member (21) positioned at a cutting station (20) and comprising two appendices (22) joined together by a concave cutting edge (23) facing said sensing station (18); said appendices (22) being substantially tangential to the path followed by said free edge (6) during said second rotation, and being urged into contact with the outer peripheral surface (11) of the reel; and cutting the band (4) transversely by the progressive engagement of said appendices (22) below said free edge (6) from opposite sides of the band (4); said angle terminating at said cutting station (20) immediately downstream of said cutting edge (23) in the normal unwinding direction (27).

2. A method as claimed in claim 1, characterised by comprising the further stage of imposing on the reel (2) a third rotation about its axis (10) in the opposite direction to that of the second rotation, in order to disengage said free edge (6) from the cutting member and move it towards a position of commencement of normal unwinding.

3. A method as claimed in claim 2, characterised in that said first and second rotation are effected in the same direction (27).

4. A method as claimed in claim 1, characterised in that said first and second rotation are effected in the same direction (27).

5. A device for cutting an adhesive sealing band (4) on a reel (2) of web material (3), said band (4) securing the free end edge (6) of the initial turn (5) of the reel (2) in position, characterised by comprising a support (8) for said reel (2); a motorized unwinding device (7) for rotating the reel (2) about its axis (10); a sensor (17) which faces the outer peripheral surface (11) of the reel (2) at a sensing station (18) to sense the passage of said free edge (6) in front of the sensor (17) and cause the motorized unwinding device (7) to rotate the reel (2) in the normal unwinding direction (27) in order to move said initial turn (5), with said free edge (6) leading, towards a fixed cutting member (20) for said band (4); a cutting member (21) positioned at said cutting station (20) and comprising two appendices (22) facing the sensing station (18) and joined together by a concave cutting edge (23); and pusher means (25) cooperating with said appendices (22) to urge the appendices (22) into contact with the outer peripheral surface (11) of the reel (2).

6. A device as claimed in claim 5, characterised in that the concave cutting edge (23) of the cutting member (21) is substantially of V-shape.

7. A device as claimed in claim 6, characterised in that said cutting member (21) comprises an elastic blade (21) projectingly mounted in a fixed position at said cutting station (20); said cutting edge (23) being a free end edge of the blade (21).

8. A device as claimed in claim 5, characterised in that said cutting member (21) comprises an elastic blade (21) projectingly mounted in a fixed position at said cutting station (20); said cutting edge (23) being a free end edge of the blade (21).

9. A device as claimed in claim 8, characterised in that said pusher means (25) comprise an actuator substantially perpendicular to said blade (21) and cooperating with the blade (21) to move said cutting edge (23) in a direction substantially radial to the reel (2) towards and from a position tangential to the peripheral surface (11) of the reel (2).

10. A device as claimed in claim 8, characterised in that said pusher means (25) comprise an actuator substantially perpendicular to said blade (21) and cooperating with the blade (21) to deflect it in a direction substantially radial to the reel (2) towards and from a position in which said cutting edge (23) is tangential to the outer peripheral surface (11) of the reel (2).

* * * * *